US005330216A

United States Patent [19]

Schnell

[11] Patent Number: 5,330,216

[45] Date of Patent: Jul. 19, 1994

[54] WALL MOUNTED PIPE CLAMP

[75] Inventor: Mark Schnell, Kiel, Wis.

[73] Assignee: Adjustable Clamp Co., Chicago, Ill.

[21] Appl. No.: 55,261

[22] Filed: Apr. 28, 1993

[51] Int. Cl.[5] ..... B25B 1/24

[52] U.S. Cl. ..... 269/45; 269/99; 269/148; 269/152; 269/203; 269/166; 269/43

[58] Field of Search ..... 269/45, 99, 147–149, 269/152, 203, 166, 43; 248/298, 231.7; 5/621–624

[56] References Cited

U.S. PATENT DOCUMENTS

| | | | |
|---|---|---|---|
| 568,543 | 9/1896 | Parks | 269/45 |
| 646,835 | 4/1900 | Jackson | 248/231.7 |
| 754,503 | 3/1904 | Rubicam et al. . | |
| 1,305,321 | 6/1919 | Tooker | 269/99 |
| 1,621,262 | 3/1927 | MacQuarrie . | |
| 1,800,386 | 4/1931 | Hoffman . | |
| 1,800,387 | 4/1931 | Greist . | |
| 1,807,356 | 5/1931 | Vance | 248/298 |
| 2,628,799 | 2/1953 | Aaby | 248/298 |
| 3,094,305 | 6/1963 | Lohrman . | |
| 4,094,415 | 6/1978 | Larson . | |
| 4,308,961 | 1/1982 | Kunce . | |
| 4,386,767 | 6/1983 | Dyckes et al. | 269/152 |
| 5,002,264 | 3/1991 | Nimtz | 269/147 |
| 5,217,181 | 6/1993 | Hammarskjold et al. | 248/298 |

FOREIGN PATENT DOCUMENTS

| | | | |
|---|---|---|---|
| 887280 | 1/1962 | United Kingdom | 248/298 |

*Primary Examiner*—Robert C. Watson

*Attorney, Agent, or Firm*—Lockwood, Alex, FitzGibbon & Cummings

[57] ABSTRACT

A wall-mounted pipe clamp installation and a mounting kit therefor. The kit comprises an elongated wall bracket having its upper and bottom edges in the form of downwardly and upwardly facing and opposing channels respectively and a pair of pipe end receiving sockets slidably mountable in the bracket. Each socket has a base with exposed upper and lower edges spaced to fit in bracket supported relationship in the channels and a projecting socket formation for receiving a pipe end therein. Each socket formation is preferably provided with a set screw to secure therein the free pipe end of each pipe clamp of a pipe clamp installation.

5 Claims, 2 Drawing Sheets

WALL MOUNTED PIPE CLAMP

BACKGROUND AND DESCRIPTION OF THE INVENTION

This invention relates, generally, to a wall mounted pipe clamp installation and to kits for making the same.

Pipe clamps are well known, readily available tools. They are used both professionally and by do-it-yourself persons in order to accomplish a wide variety of clamping operations wherein relatively large workpieces need to be secured together for significant periods of time. In workshops space is often at a premium both for setting up a clamping operation and for maintaining it while waiting for glue to set or for another operation to be performed thereon.

According to the present invention, a wall mounted pipe clamp installation is provided, including a kit for making the same, which permits the use of a free or unused wall space which is often available. Such an installation may be used in performing various clamping operations wherein pipe clamps are advantageously supported in a cantilevered arrangement from a wall at a convenient working height.

The object of the invention, generally stated, is the provision of an economical, easy to install wall mounted pipe clamp installation and kit for making the same. The nature of the invention will be apparent and fully understood in view of the following detailed description thereof taken in connection with the accompanying drawings wherein.

Figure 3:
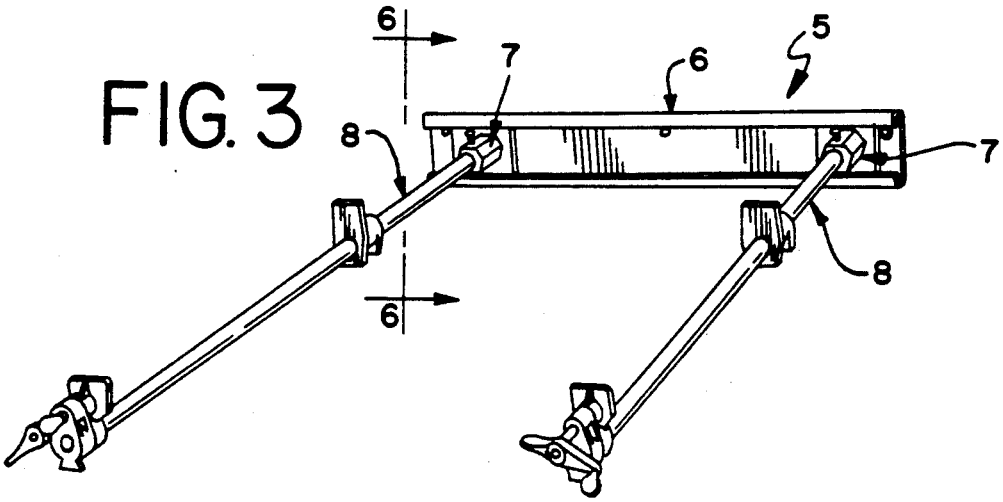
FIG. 3 is a perspective view of a pipe clamp installation of the present invention without any workpieces present.
Figure 4:
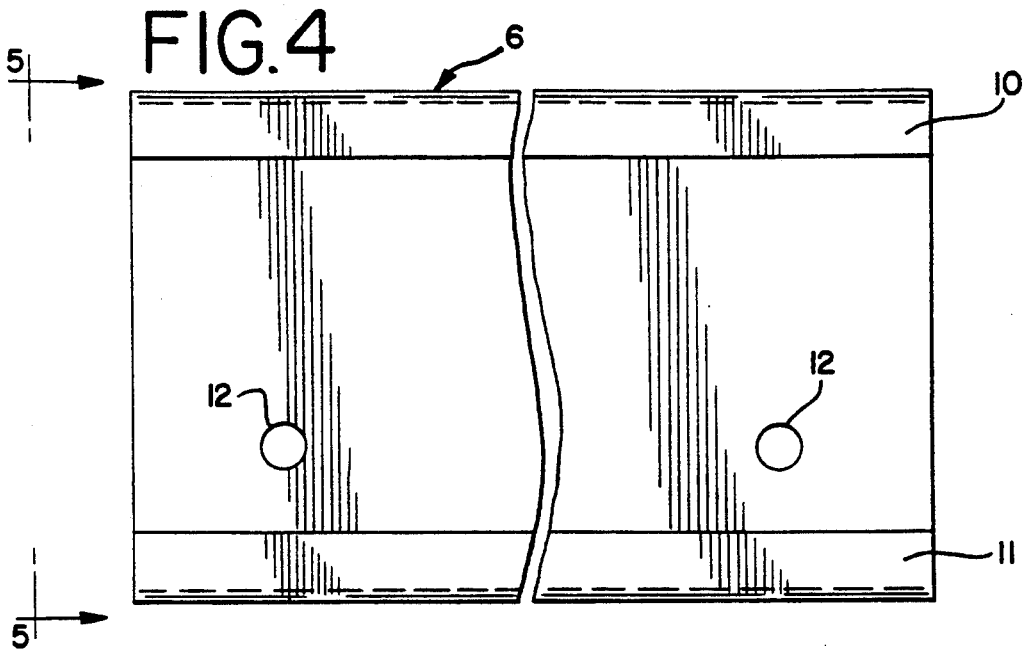
FIG. 4 is an elevational view of the wall bracket which forms one component of a kit for forming the pipe clamp installation shown in FIG. 3.
Figure 5:
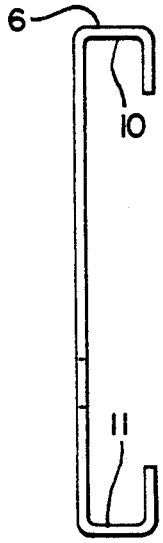
FIG. 5 is an end elevational view taken along line 5—5 of FIG. 4.

In FIG. 3, a pipe clamp installation is indicated generally at 5 comprising a wall bracket indicated generally at 6, a pair of pipe end receiving sockets indicated generally at 7—7 and a pair of pipe clamps of conventional known commercial type indicated generally at 8—8.

Figure 6:
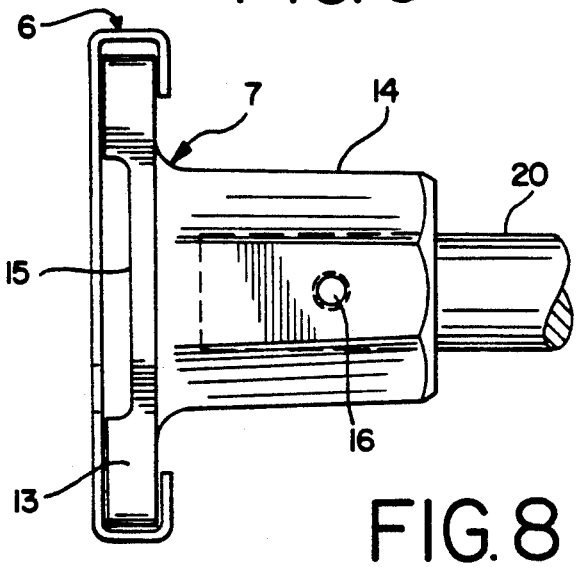
FIG. 6 is an end elevational view corresponding in scale to FIGS. 4 and 5 and taken on line 6—6 of FIG. 3.
Figure 7:
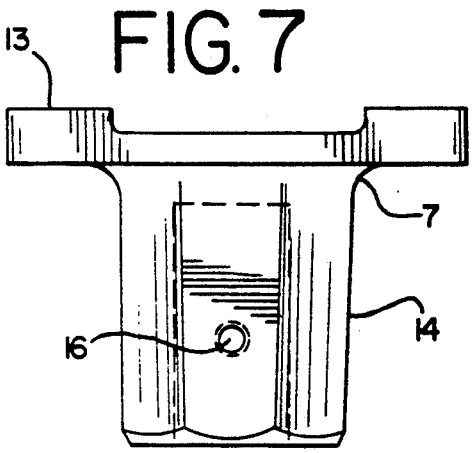
FIG. 7 is a top plan view of the pipe end receiving socket shown in FIG. 6.

The wall bracket 6 is formed from a strip of metal or other suitable material so as to have upper and lower channels 10 and 11, respectively, extending along its upper and lower edges. The bracket 6 is provided with a plurality of apertures 12—12 which serve as holes for screws or nails used to secure the bracket to a wall or other vertical surface. Two or more pipe end receiving sockets 7 are provided comprising a square or rectangular base 13 and a projecting pipe end receiving socket formation 14. The top and bottom exposed edges of the base 6 have such thickness and vertical dimension as to fit readily and securely in the channels 10 and 11 of the bracket 6 as shown in FIG. 6. Preferably, the rear side of the base 6 is partially relieved as indicated at 15 so as to provide clearance for the heads of screws or other fasteners used to mount the wall bracket 6.

Figure 8:
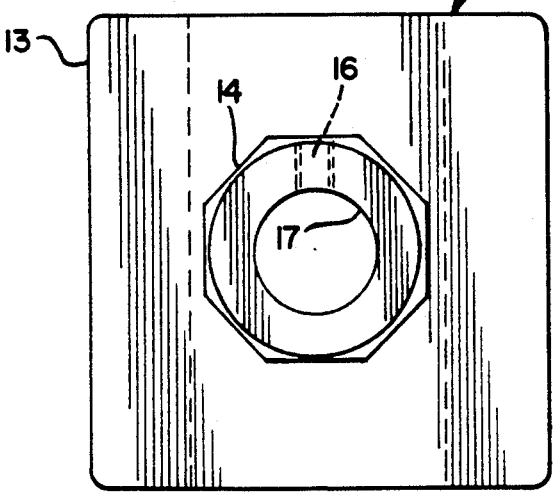
FIG. 8 a front elevational view of the pipe end receiving socket shown in FIGS. 6 and 7.

The socket formation 14 is preferably flat sided and provided with a tapped set screw hole 16 to receive a set screw. The socket formation 14 has a socket hole or recess 17 (FIG. 8) dimensioned to receive the end 20 (FIG. 6) of a pipe clamp 8. By tightening a set screw in the tapped opening 16, the pipe end 20 may be locked or fastened into place against accidental removal.

Figure 1:
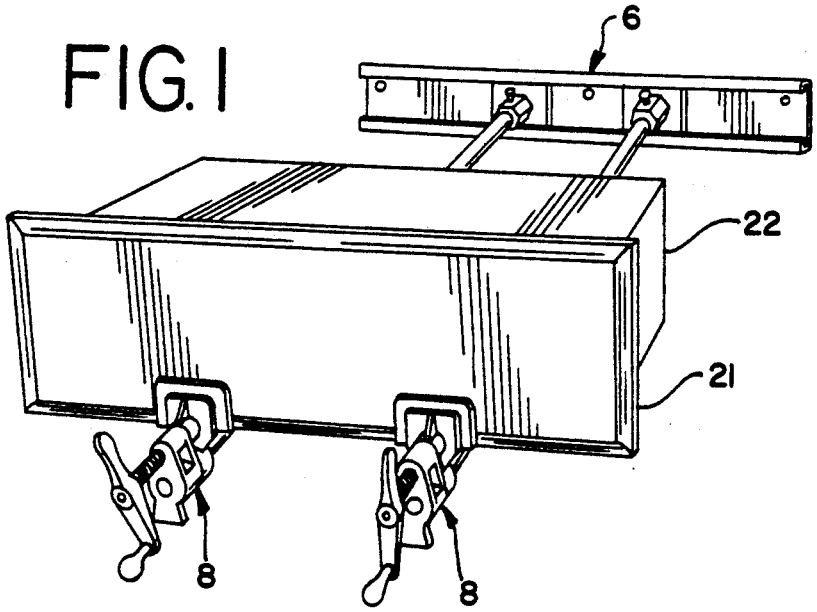
FIG. 1 is a perspective view showing a pipe clamp installation embodying the present invention and illustrating its use in performing a typical clamping operation.
Figure 2:
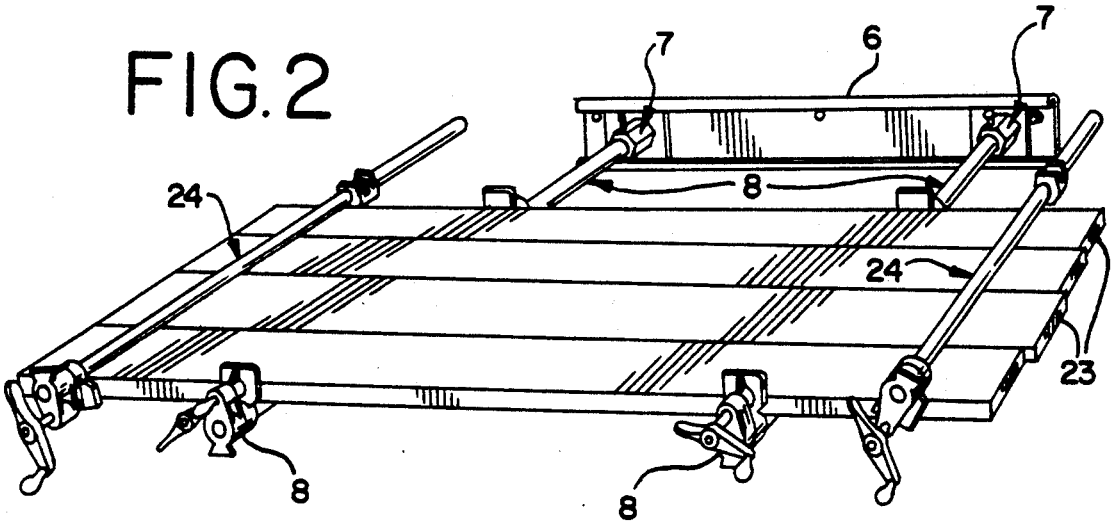
FIG. 2 is a perspective view of a second pipe clamp installation in use for performing a different type of clamping operation.

In use, the pipe ends 20 of a pair of the pipe clamps 8 are inserted into the socket formations 14 on the socket 7 and then the set screws are firmly tightened. The sockets 7 are then spread apart the desired distance depending upon the job to be accomplished in the installation 5. In FIG. 1, the clamps 8 are shown clamping a panel 21 to a workpiece 22. In FIG. 2, the pipe clamps 8 are shown set up to clamp together four boards 23 with the assistance of two additional pipe clamps 24—24.

It will be appreciated that several of the brackets 6 may be mounted on the same wall, either in a vertical arrangement or in a side-by-side arrangement. By lengthening the wall bracket 6 and providing a suitable number of the sockets 7 it will be seen that pipe clamp installations of various widths may be set up to handle projects of substantial width.

By having the pipe clamps 8 mounted in cantilever fashion from a wall bracket 6, the installation 5 can be utilized to accommodate workpieces with vertical dimensions which extend both above and below the level of the pipe clamps 8. Further, if for any reason it is desired to set up one job and then set it aside for another job, it will be seen that it is only necessary to loosen the set screws in the socket formations 14 and withdraw the pipe ends from the sockets.

What is claimed:

1. A wall mounted pipe clamp installation comprising, an elongated wall bracket mounted flatwise and horizontally on a wall and having upper and lower edges in the form of parallel downwardly and upwardly facing channels, a pair of pipe end receiving sockets mounted on said wall bracket and each comprising a base with exposed parallel edges interfitting in bracket supported relationship in said channels and an outwardly projecting pipe end receiving socket formation, and a pair of pipe clamps with the distal end of each pipe secured in a said socket formation.

2. An installation as called for in claim 1 wherein each of said sockets is integrally formed in one piece.

3. An installation as called for in claim 1 wherein each said pipe end receiving socket formation includes a set screw to secure each pipe end in place.

4. An installation as called for in claim 1 wherein each of said sockets is adjustably slidable on said bracket.

5. An installation as called for in claim 1 wherein each said socket base is rectangular and each said pipe end receiving socket is integral therewith.

* * * * *